US007322550B2

(12) United States Patent
Killion

(10) Patent No.: US 7,322,550 B2
(45) Date of Patent: Jan. 29, 2008

(54) MAGNETIC HOLDER

(76) Inventor: Thomas Killion, 5534 Woodacre Ct., Indianapolis, IN (US) 46234

( * ) Notice: Subject to any disclaimer, the term of this patent is extended or adjusted under 35 U.S.C. 154(b) by 209 days.

(21) Appl. No.: 11/139,091

(22) Filed: May 27, 2005

(65) Prior Publication Data

US 2006/0266914 A1 Nov. 30, 2006

(51) Int. Cl.
*A47G 1/17* (2006.01)

(52) U.S. Cl. ..... 248/206.5; 248/309.4; 24/303

(58) Field of Classification Search ..... 248/467, 248/683, 309.4, 206.5; 24/67.11, 303
See application file for complete search history.

(56) References Cited

U.S. PATENT DOCUMENTS

| | | | |
|---|---|---|---|
| 2,693,370 | A | 11/1954 | Wheatley |
| 4,830,321 | A | 5/1989 | Irie |
| 4,971,278 | A | 11/1990 | Woods |
| 5,702,778 | A | 12/1997 | Andonian |
| 5,782,445 | A | 7/1998 | Cleek |
| 5,996,821 | A | 12/1999 | Farber et al. |
| 6,106,937 | A | 8/2000 | Hamerski |
| 6,153,279 | A | 11/2000 | Charley |
| 6,302,363 | B1 | 10/2001 | Olson et al. |
| 6,491,271 | B1 * | 12/2002 | Adams ..... 248/206.5 |
| 2005/0023420 | A1 | 2/2005 | Sadeh et al. |

OTHER PUBLICATIONS

2003 Clay Critters Catalog, 7 page printout.
Excerpts from Bentcil.com web site, Magnets—Die Cut.
Excerpts from Fridgedoor.com web site, Celebrity & Sports Magnets.
Excerpts from www.refrigeratormagnets.com web site, Custom Refrigerator Magnets, Photo Magnets for Weddings, Baby Announcements, Anniversaries, etc.

* cited by examiner

*Primary Examiner*—Carl D. Friedman
*Assistant Examiner*—Bradley H Duckworth
(74) *Attorney, Agent, or Firm*—E. Victor Indiano; Indiano Vaughan LLP

(57) ABSTRACT

A magnetic holder for holding a non-magnetic sheet against a magnetically attractive surface contains a body having a first end and a second end, an upper surface and a lower surface. The body is formed from a first material having a first co-efficient of friction. The lower surface has a first portion and a second portion. The first portion is joined to the second portion at a fulcrum line that defines an obtuse angle between the first portion and the second portion for preventing the first and second portions from engaging the magnetically attractive surface simultaneously. A magnet member is disposed on the second portion for magnetically coupling the holder to the magnetically attractive surface. A first gripping member is disposed on the second portion for frictionally gripping the non-magnetic sheet.

27 Claims, 6 Drawing Sheets

MAGNETIC HOLDER

TECHNICAL FIELD OF THE INVENTION

The present invention relates to magnetic holders, and in particular, to magnetic holders of the type that are often used to hold a non-magnetic sheet, such as a picture, paper piece or the like to a magnetically-attractive surface, such as a refrigerator door, file cabinet door, clip board or the like.

BACKGROUND OF THE INVENTION

A wide variety of magnetic holders are used to hold sheet-like, non-metallic objects, such as photographs and paper sheets to a magnetic surface, such as a refrigerator door, file cabinet door, clip board or the like. Consumers will often purchase such magnets because of their decorative properties, and a large industry has arisen to create and market such magnetic devices.

For example, products sold by Clay Critters, Inc. of West Lafayette, Ind. include a variety of animal and whimsical-shaped magnets. The CLAY CRITTERS magnets typically have a body portion formed of ceramic that includes a three dimensionally shaped upper surface and a generally planar rear surface. A magnet is fixedly attached to the planar back surface of the body portion, thus enabling the device to "stick" onto a magnetically attractive surface, such as a refrigerator door. See the CLAY CRITTERS catalog or www.claycritters.com.

Other decorative holders can be found at, for example, www.fridgedoor.com. The fridgedoor.com magnets are constructed differently than those sold by CLAY CRITTERS. It appears that the fridgedoor.com magnets are sheet-like magnets having both a planar upper surface and a planar lower surface. Magnets of this type can be made from a flexible plastic having a magnetic material applied to the lower surfaces thereof. The magnets sold by fridgedoor.com have a wide variety of different available pictures shown on the front, such as pictures of celebrities and cartoon characters, such as Betty Boop. See the printout from www.fridgedoor-.com web site.

In addition to magnets of this type being used for decorative purposes, they are also used by businesses as advertising vehicles. Businesses will often purchase decorative magnetic holders such as those shown at www.refrigerator-magnets.com, a subsidiary of the Art Works. Magnetic holders of this type are constructed generally similarly to the decorative magnets shown at www.frigedoor.com. However, rather than having a celebrity picture or art piece printed on the fronts, these business promotional magnetic holders usually have information about the particular business that purchases the magnets. For example, a pizza parlor may purchase such a magnet, and have the name of the pizza parlor, its hours of operation and its phone number printed on the face of the magnet.

Magnetic holders of this type are either sold or given away free by the business to its customers, in the hope that the customers will place the holder on their refrigerators. By placing the magnetic holders on the refrigerator with the businesses name contained thereon, the customers are reminded of the existence of the business. In the example given above for the pizza parlor, it is the hope that the customer, when next ordering pizza, will call the particular pizza parlor that produced the holder, because the customer has been reminded of the particular pizza parlor's existence every time that he looks at the refrigerator, and has easy access to the pizza parlor's name and phone number by virtue of the name and phone number being printed on the face (upper surface) of the magnetic holder.

Magnetic holders such as those described above are often used to hold non-magnetic sheets upon a magnetically attractive surface, such as the refrigerator door. In the kitchens of many homes, especially those homes whose owners have children or grandchildren, one will often see a large number of magnetic holders attached onto the door of the refrigerator. The magnetic holders are often used to hold sheet-like objects, such as children's pictures, children's school papers, pictures colored by children, phone lists, grocery lists, and the like for display on the refrigerator.

Another type of refrigerator magnet is shown at Olson et al., U.S. Pat. No. 6,302,363. The Olson device shows a refrigerator magnet having a bi-planar bottom surface that includes a first bottom planar magnetic surface, and a second bottom planar magnetic surface. The bottom magnetic surfaces are joined together along the common bend line that defines an obtuse angle. In one embodiment, one of the magnetic surfaces is in contact with the metallic surface (e.g. refrigerator door) leaving one or more paper receiving gaps between the other magnetic surface and the refrigerator door. The bend line functions as a fulcrum whereby the body may be flipped by the application of finger pressure to lift the first magnetic surface from the metallic surface, and cause one of the other magnetic surfaces to clamp the paper and hold it magnetically against the metallic surface. The magnetic attraction between the body along the bend lines and the magnetic surface is said to hold the body in place while being flipped from one position to the other.

Examples of other types of magnetic holders are shown at Irie, U.S. Pat. No. 4,830,321; Woods, U.S. Pat. No. 4,971,278; Andonian, U.S. Pat. No. 5,702,778; and Wheatley, U.S. Pat. No. 2,693,370. Additionally, Clekus, U.S. Pat. No. 5,782,445 discloses a mounting and locating device for a breakaway tool holder that uses a magnetic holding device.

Although the devices discussed above most likely perform their intended functions in a workmanlike manner, room for improvement exists.

In particular, room for improvement exists in providing a device that provides a means for more securely gripping onto the paper piece or photograph than some of the known prior art devices. Additionally, room for improvement exists in providing such a device that is simple, and inexpensive to manufacture, to enable the device to be manufactured and priced at a point wherein it will be an attractive promotional product for businesses, and an attractive decorative product for consumers.

One object of the present invention is to provide such a device.

SUMMARY OF THE INVENTION

In accordance with the present invention, a magnetic holder is provided for holding a non-magnetic sheet against a magnetically attractive surface. The holder comprises a body having a first end and a second end; and an upper surface and a lower surface. The body is formed from a first material having a first co-efficient of friction. The lower surface includes a first portion and a second portion. The first portion is joined to the second portion at a fulcrum line that defines an obtuse angle between the first portion and the second portion for preventing the first and second portions from engaging the magnetically attractive surface simultaneously. A magnet member is disposed on the second portion for magnetically coupling the holder to the magnetically attractive surface. A first gripping member is disposed on the second portion for frictionally gripping the non-magnetic sheet.

In a preferred embodiment, the first gripping member is comprised of a second material having a second co-efficient of friction that is greater than the first co-efficient of friction. Additionally, the lower portion preferably includes at least one well, and the first gripping member includes at least one leg received within the well for securing the first gripping member to the body.

In a most preferred embodiment, the device further includes a second gripping member that is disposed adjacent to the first end for frictionally gripping the magnetically attractive surface. The second gripping member is comprised of a material having a third co-efficient of friction that is greater than the first co-efficient of friction. The body preferably includes a grip receiving aperture that is disposed adjacent to the first end for receiving the second gripping member; and the second gripping member includes an upper portion disposed above the upper surface; a lower portion disposed below the lower surface; and a middle portion extending through the grip receiving aperture.

Also according to the present invention, a magnetic holder is provided for holding a non-magnetic sheet against a magnetically attractive surface. The magnetic holder comprises a body having a first end and a second end; an upper surface and a lower surface. The body is formed from material having a first co-efficient of friction. The lower surface includes a first portion and a second portion. The first portion is joined to the second portion at a fulcrum line that defines an obtuse angle between the first portion and the second portion for preventing the first and second portions from engaging the magnetically attractive surface simultaneously. A magnetic member is disposed on the second portion for magnetically coupling the holder to the magnetically attractive surface. A surface gripping member is disposed adjacent to the first end for frictionally engaging the magnetically attractive surface. The surface gripping member is comprised of a surface gripping material having a third co-efficient of friction greater than the first co-efficient of friction.

Preferably, the magnetic holder is moveable between a gripping position and a release position. In the gripping position, the second portion of the lower surface engages the magnetically attractive surface, and the first end is spatially separated from the magnetically attractive surface. In the release position, the first portion of a lower surface engages the magnetically attractive surface, and the second end is spatially separated from the magnetically attractive surface. When the magnetically holder is in the grip position, the first end is spatially separated from the magnetic surface by a sufficient distance to permit a standard sized pencil to be retained between the first end and the magnetically attractive surface.

One feature of the present invention is that it includes a first lower portion and a second lower portion that are joined at a fulcrum line, that defines an obtuse angle, to enable the holder to move between a grip position and a release position. In a grip position, the magnetic and object gripping members are placed against the magnetically attractive surface and the sheet to-be-held to securely hold the sheet onto the magnetically attractive surface. In the release position, the magnetic holder is rotated about its fulcrum line so that the second portion becomes disengaged, and the first portion becomes disposed adjacent to the magnetically attractive surface. In the release position, the sheet being held can be removed from its place on the surface, and if desired, the user can replace the sheet with another one.

It is also a feature of the present invention that the holder includes a sheet-gripping member disposed on the lower surface of the holder for frictionally gripping the non-magnetic sheet. Preferably, the sheet gripping member has a co-efficient friction that is greater than the plastic from which the body portion of the holder is made.

This feature has the advantage of providing a holder that grips a non-magnetic sheet (such as a picture or grocery list) more securely than is possible with the generally harder, smoother and lower co-efficient of friction material from which the body is made. This secure grip is accomplished because the holder of the present invention holds the picture with a combined force of magnetic attraction (between the holder and the magnetically attractive surface) and the frictional engagement of the gripping member and a non-magnetic paper sheet or picture.

Another feature of the present invention is that a surface gripping member is provided on the first end of the body that, when the device is moved about its fulcrum line into the release position, frictionally engages the surface to which the magnetic holder is attached with a relatively high co-efficient of friction material.

This feature has the advantage of helping to hold the holder in one spot on the magnetically attractive surface when the magnetic attraction between the holder and the surface is reduced by virtue of the holder being moved into its release position. By employing the relatively higher friction material to help hold the holder in place, the holder is less likely to either become dislodged from the magnetically attractive surface, or to slide to another, undesired position on the refrigerator. By helping to maintain the holder in a desired position on the magnetically attractive surface, the replacement of one non-magnetic sheet for another is facilitated.

These and other features and advantages of the present invention will become apparent to those skilled in the art upon a review of the drawings and detailed description set forth below that describes the best mode of practicing the invention perceived presently by the applicant.

DETAILED DESCRIPTION

Figure 1:
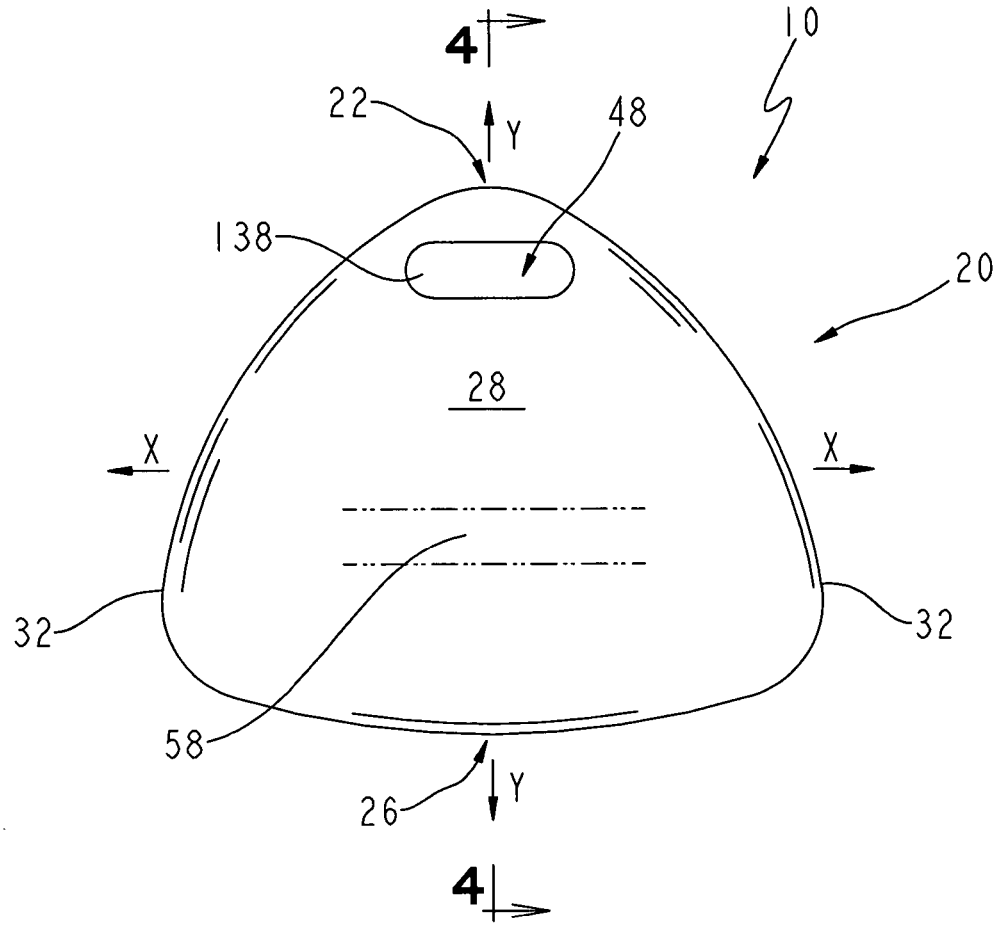
FIG. 1 is a top side view of the magnetic holder of the present invention.
Figure 2:
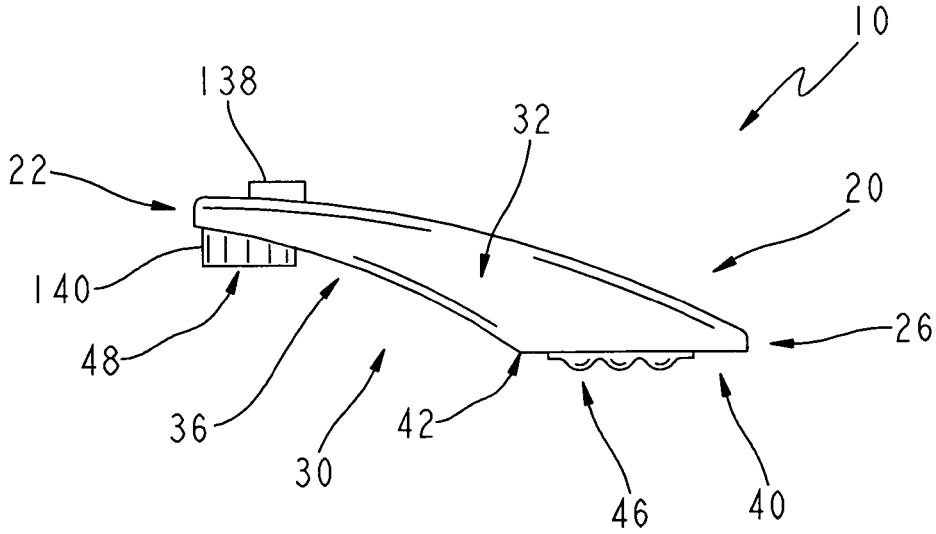
FIG. 2 is a side view thereof.
Figure 3:
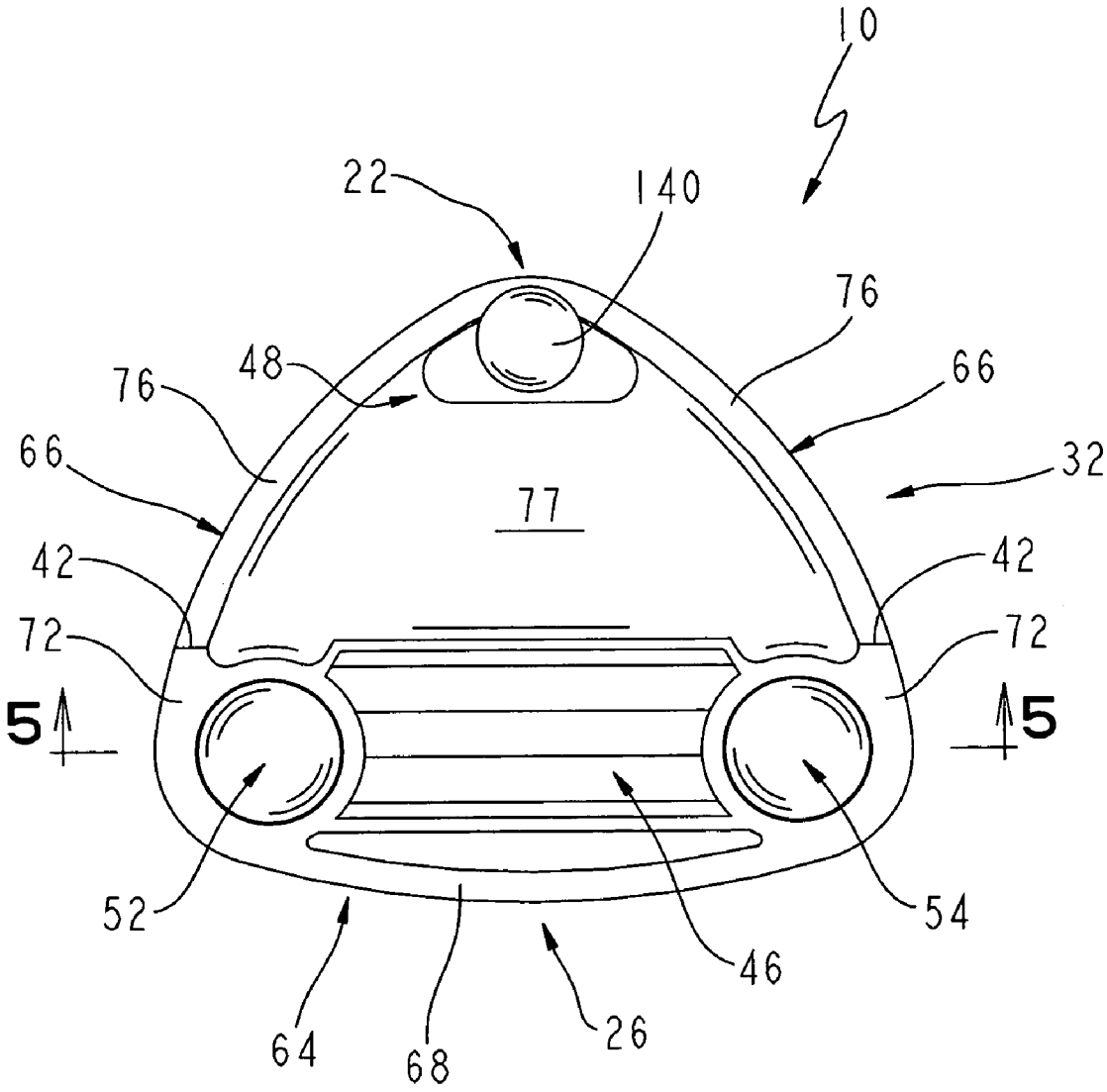
FIG. 3 is a bottom view thereof.

A magnetic holder 10 of the present invention is shown in the figures for holding a non-magnetic sheet, such as a picture 12 or grocery list (FIGS. 7 and 8) onto a magnetically attractive surface, such as the outer surface 14 of a refrigerator door 16. As best shown in FIGS. 1-3, the magnetic holder 10 includes a body that, from a top view, can be generally clam shell-like in appearance, as comprising a triangle having rounded corners. The body 20 includes a first end 22 and a second end 26, an upper surface 28 and a lower surface 30. The lower surface 30 is the surface that is placed against the magnetically attractive refrigerator door surface 14, and also against the picture 12. A perimetral skirt 32 of varying height extends generally perpendicular from the plane of the upper and lower surfaces 28, 30, and extends generally along the perimeter of the body 20. The upper surface 28 is curvi-planar, so that lines stretched across the magnetic laterally, in a direction generally parallel to lines x-x are generally linear in nature, and lines that extend generally parallel to lines y-y (perpendicular to lines x-x) across the upper surface 28 of the body 20 are generally arcuate in nature.

The lower surface 30 includes a first portion 36, which, like upper surface 28 is generally curvi-planar in nature, and a second portion 40. Second portion 40 of lower surface 30 is generally planar in nature, although it contains features, such as wells into which magnets and a gripping member can be placed. The second portion 40 is the portion that is sized and configured for being magnetically attracted to the magnetically attractive refrigerator door 16 surface 14, to hold the non-magnetic picture 12 to the refrigerator door surface 14.

Figure 6:
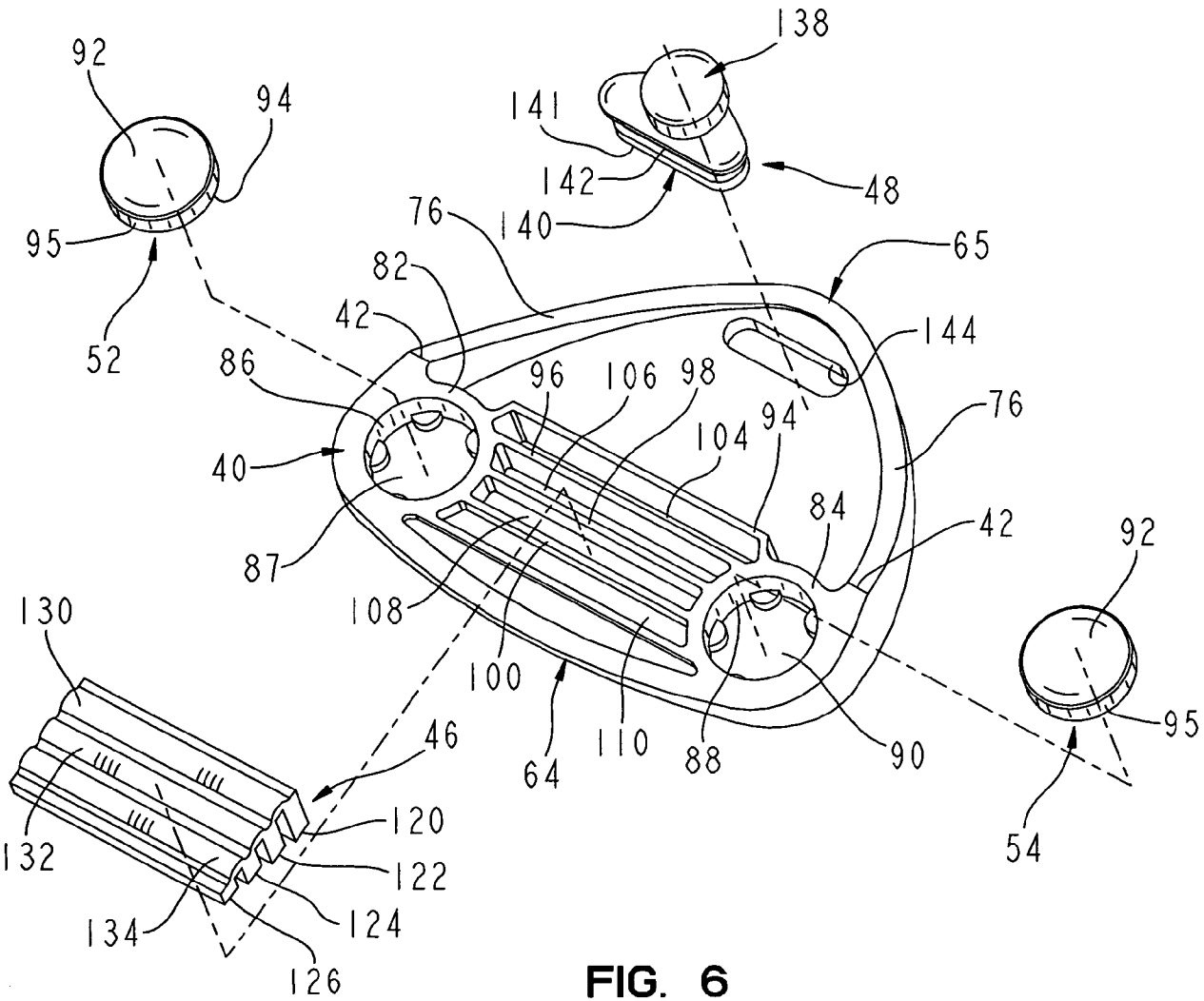
FIG. 6 is an exploded bottom view of the present invention.

The first portion 36 and second portion 40 of lower surface 30 are joined at a fulcrum line 42 that defines an obtuse angle between the first portion 36 and the second portion 40 of the lower surface 30. The obtuse angle defined by the fulcrum line 42 is preferably between about 120 and 170 degrees, and provides an angle between the first portion 36 and second portion 40 of the lower surface 30 that prevents the first and second portions 36, 40 of the lower surface 30 from engaging the magnetically attractive surface 14 of the refrigerator door 16 simultaneously. As best shown in FIG. 6, the fulcrum line 42 is defined by the bend line on the lower edge of the perimetral skirt 32, along with the first parallel wall 94 that extends co-linearly with the bend lines 42.

The holder also includes a first, sheet-gripping member 46 that is made from a material having a greater co-efficient to friction than the body 20. The first sheet-gripping member 46 is disposed adjacent to the second end 26 for frictionally gripping the non-magnetic sheet, such as picture 12. A second, surface gripping member 48 is disposed adjacent to the first end 22 for frictionally engaging the magnetically attractive surface 14, when the holder 10 is in its release position. The surface-gripping member 48 is comprised of a gripping material having a surface with a co-efficient of friction that is greater than the co-efficient to friction of the material from which the body 20 is made. The coefficients of friction of each of the sheet-gripping member 46 and surface-gripping member 48 can be identical, or different, although both should be greater than the co-efficient of friction of the material from which the body 20 is made.

The holder 10 also includes first and second disk-shaped magnets 52, 54 that are disposed on the second portion 40 of the lower surface 30. The magnets 52, 54 are provided for providing the magnetic attraction necessary to attach the holder 10 to the refrigerator door surface 14.

The body 20 is formed of one primary piece, that is designed to be injection molded from a hard and durable plastic. As will become evident upon further description, the body is shaped and configured to be easily formed with an injection mold, so that the mold halves can pull apart and separate easily without any undue interference from parts of the body 20. As is typical of most plastics of the type from which the body 20 is preferably made, the resultant body 20 is formed to have a hard, smooth surface, that generally has a relatively low co-efficient to friction. This low co-efficient to friction is helpful in one regard, as it provides a smooth surface. In particular, the upper surface 28 is smooth to facilitate the printing or hot stamping of a message 58 thereon. This message 58 can be a decorative message such as a picture of flowers, or person, a cartoon character or the like.

However, for many users, the message 58 imprinted upon the upper surface 28 will be a business-related message, such as a logo or advertisement for a business, such as the hypothetical pizza parlor described in the Background portion of this application. In this regard, the particular rounded, triangular shape and configuration shown in the drawings provides the manufacturer with a reasonably large area upon which to print such an advertising message or other decorative picture.

However, it will be appreciated that the holder 10 of the present invention can employ a wide variety of shapes other than the one shown.

The perimetral skirt 32 extends around the perimeter of the upper surface 28, and extends generally perpendicular therewith. The skirt 32 includes a front skirt portion 64 that is relatively thin, and is disposed adjacent to the second end 24 of the magnetic holder 10. The front skirt portion 64 of the generally triangularly-shaped magnetic holder 10 shown in the drawings is relatively broad, when compared to the rear skirt portion 65 disposed adjacent to the first end 22 of the body 20. The front skirt portion 64 is also generally thin (relatively small height) when compared to other sections of the perimetral skirt 32.

Side skirt portion 66 extends generally between the front 64 and the rear 65 skirt portion. The front skirt portion 64 includes a lower edge segment 68 that is disposed generally co-planar with the lower edges 72 of the side skirt portions of the second portion 40 of the lower section 30. The lower edges 72 of the side skirt portions 66, and a lower edge segment 68 of the front skirt portion are disposed generally co-planarly so that they will mate well, and fit flushly against the generally planar magnetically attractive surface 14 of the refrigerator door 16.

By contrast, the lower edges 76 of the side skirt 36 of the first portion 40 of the lower surface 30 is arcuate. The lower edges 76 of the two side skirt portions are sized and configured similarly, so that they define a curvi-planar surface. It should be noted however that the plane is not continuous as a plastic-saving recessed lower surface 77 exists between the two side skirt portion edges 76 (See FIG. 3). The curvi-planar surface defined by the lower edges 76 has a generally smaller radius of curvature than the curvi-planar surface defined by the upper surface 76, the net effect of which is that when the holder 10 is placed in its grip position, as shown in FIG. 7, the gap between the lower edge 76 and the magnetically attractive surface increases as one moves away from the fulcrum line 42 and toward the first end 22 of the body 20.

Figure 7:
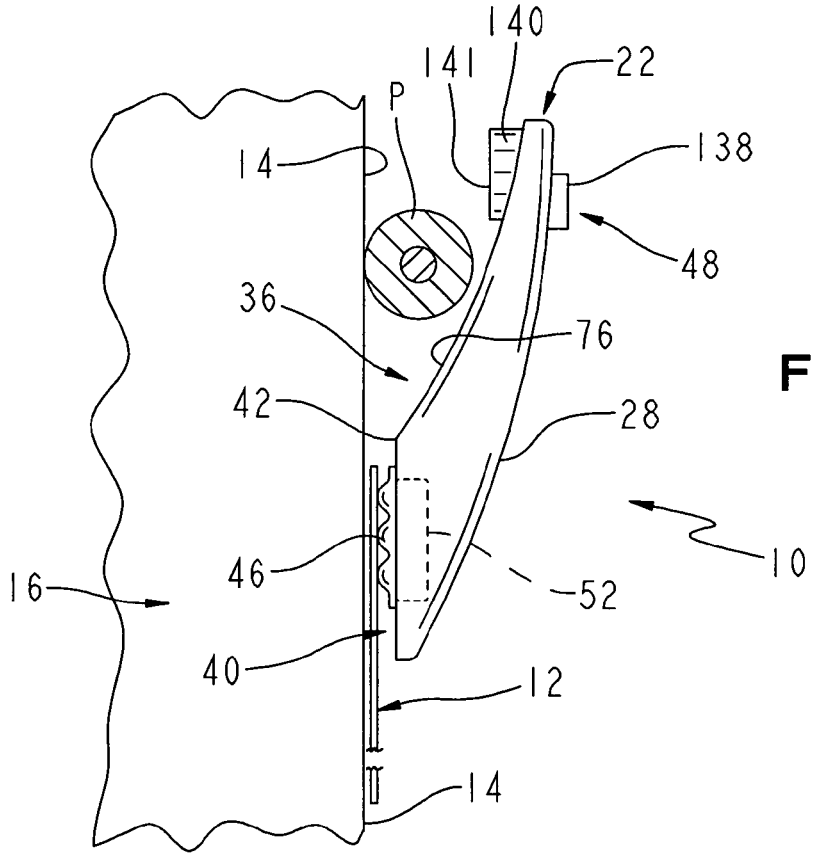
FIG. 7 is a side view of the present invention shown in its gripping position on a magnetically attractive surface.

As is also seen in FIG. 7, the gap created between lower edge 76 and the surface 14 should be great enough so that a writing instrument, such as a standard-sized pencil P, or standard-sized stick pen can fit between the lower edge surface 76 and the magnetically attractive surface 14. The two lower edges 76 should be broadly spaced to be able to balance the writing instrument P, to hold it securely and help maintain it on the holder 10.

Additionally, as the gap between the lower edge 76 and the magnetic surface 14 decreases as one gets closer to the fulcrum line 42, the pencil P is retained within the gap through its engagement on one side with the magnetically attractive surface 14, and on the other side with the lower edge 76.

Further, the gap between the lower edge 141 of the surface gripping member 48 and the magnetically attractive surface 14 should be sized so that the gap is just slightly smaller than the diameter of a standard-sized pencil to help retain the pencil P within the gap by making it more difficult for the pencil P to move upwardly out of the gap. Nonetheless, this gap should not be so small that the pencil P can only be removed from the gap by moving it sideways (in a direction along the axis of the pencil), or otherwise require the holder 10 to be disengaged from the magnetically attractive surface 14 in order to remove the pencil P.

As best shown in FIG. 6, the second portion 40 of the underside surface includes a first circular wall 82 and a second circular wall 84 that define a first magnet receiving well 86 and a second magnet receiving well 88. The magnetic receiving wells 86, 88 each include base surfaces 87, 90, respectively, for receiving first and second disk-shaped magnets 52, 54. The magnets 52, 54 each include planar upper surfaces 92 that face outwardly, and planar lower surfaces 94 that are received against the respective bases 87, 90 of the first and second magnet receiving wells 86, 88. The magnets 52, 54 also include cylindrical side surfaces 95. The magnets 52, 54 are sized to have a diameter just slightly smaller than the diameter of the circular walls 82, 84, so that the magnets can be press-fit into engagement and frictionally retained within the first and second magnet receiving wells 86, 88, respectively.

A series of generally parallelly disposed walls extend laterally between the first and second circular walls 82, 94 and define four wells for receiving the gripping member 46. The parallel walls include first parallel wall 94, second parallel wall 96, third parallel wall 98, fourth parallel wall 100 and fifth parallel wall 102. The first and second parallel walls define a first well 102. The second and third parallel walls 96, 98 define a second well 106; and the third and fourth parallel walls define a third well 108. Finally, the fourth and fifth parallel walls 100, 102 define a fourth well 110.

Figure 4:
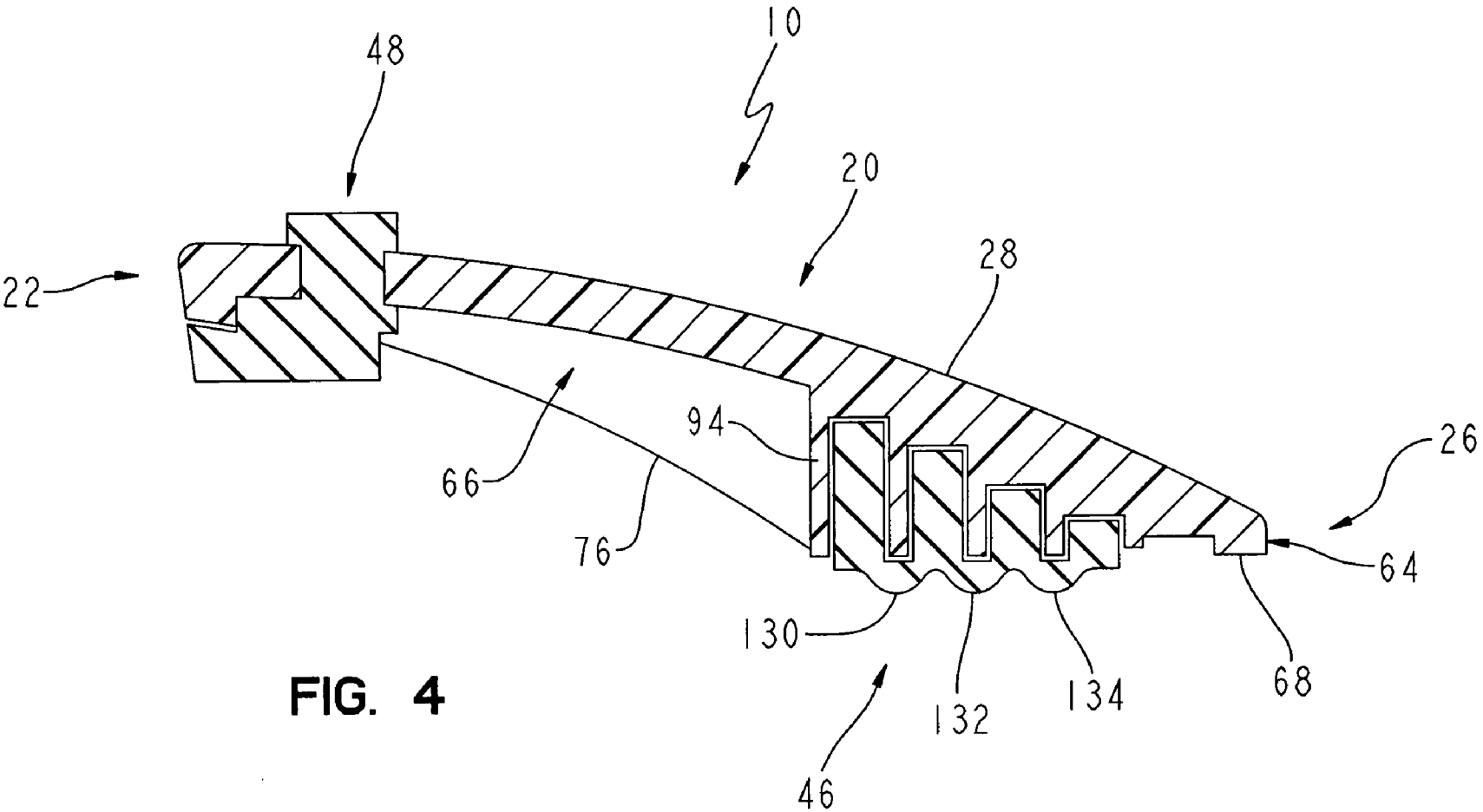
FIG. 4 is an enlarged sectional view taken along lines 4-4 of FIG. 1.

As best shown in FIG. 4, the wells 100-110 are of varying height, to receive the legs of varying length of the gripping member 46. To some extent, the increasing depth of the wells 104-110 exists because of the increasing thickness of the second end portion 40 of the holder 10. As the upper surface 28 is arcuate and a lower surface 68 is planar, the thickness of the second end increases as one moves from the second end 26 to the first end 22.

The wells 104, 106, 108, 110 are generally open topped, rectangularly cuboid wells for receiving, respectively, the first 120, second 122, third 124 and fourth 126 rectangularly cuboid legs of the gripping member 46. The rectangularly cuboid legs 120-126 are sized to have a length, and/or width slightly greater than the length and width of the wells 104-110. As the gripping member 126 is preferably made from a compressible, high co-efficient of friction surfaced rubber-like material, the legs 120, 122, 124, 126 can be compressed to force them into the wells 104, 106, 108, 110.

The compression of the legs 120, 126 when in the wells 104, 110 causes the legs to exert an expansive pressure against the surfaces of the walls 94, 96, 98, 100, 102, so that the exerted pressure helps to retain the legs 120-126 within the wells 104-110. This pressure inducing engagement, when coupled with the generally high co-efficient to friction of the surfaces of the leg 120-126 helps to maintain the legs 120-126 securely within the wells 104-110, and hence, helps to maintain the gripping member 46 securely on the body 20 of the magnetic holder 10.

The gripping member 46 is a one-piece, unitarily formed unit. The gripping member 46 preferably formed from a rubber-like material that is both compressible, and has a surface having a co-efficient of friction that is great than the co-efficient of friction of the plastic body member 20. When the legs 120-126 of the gripping member 46 are inserted within the wells 104-110, the lower surface of the gripping member 46 is formed to have three compressible semi-cylindrical, sheet-engaging portions, including a first sheet engaging portion 130, a second sheet engaging portion 132, and a third sheet engaging portion 134. These sheet engaging portions 130, 132, 134 have their apices positioned generally above the second, third and fourth parallel walls 96, 98, 100, respectively.

Figure 5:
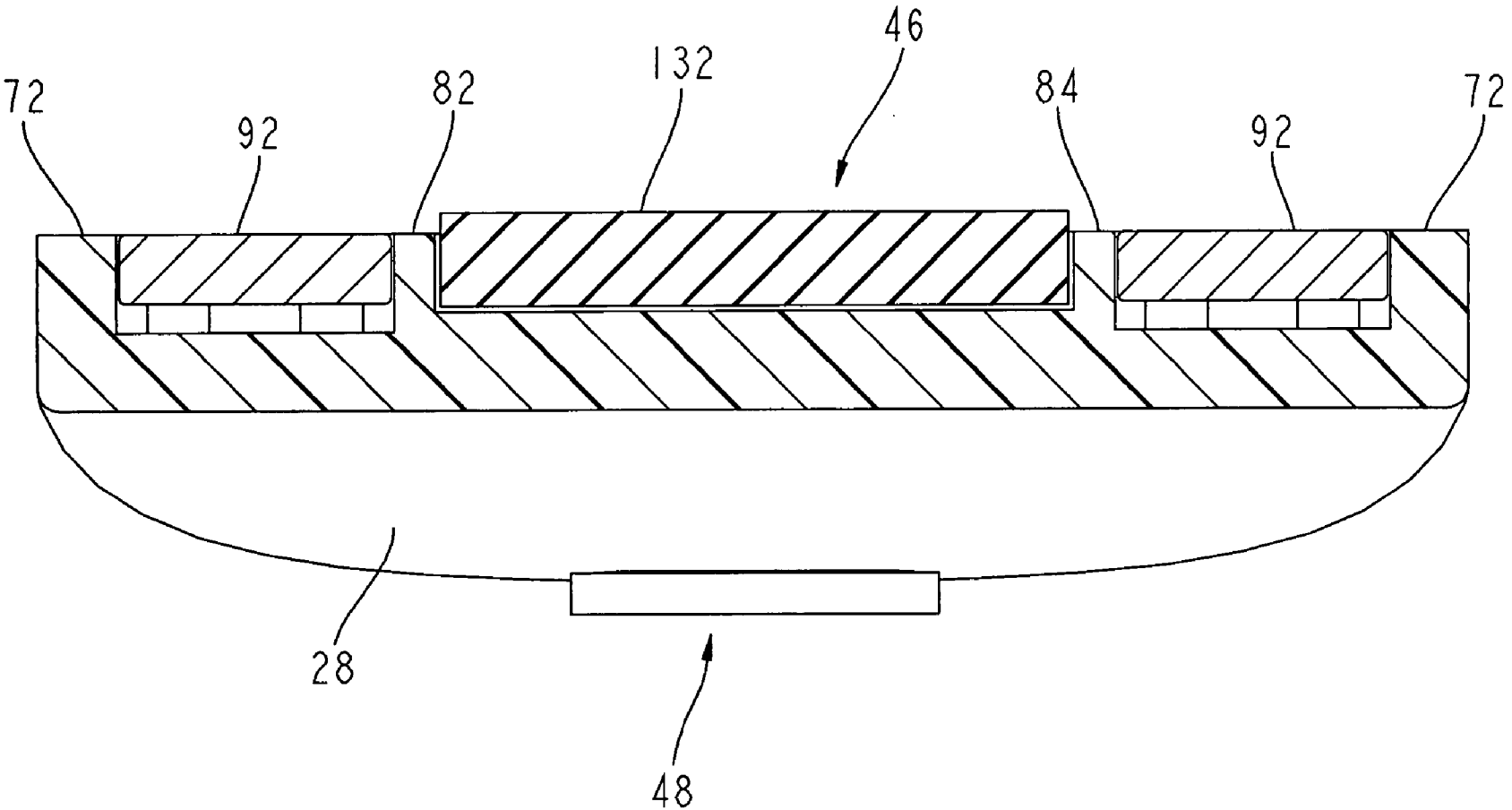
FIG. 5 is an enlarged sectional view taken along lines 5-5 of FIG. 3.

As best shown in FIG. 5, the second portion 40 of the lower surface 30 is generally planar in configuration, with the plane being defined by lower edges 72 of the perimetral skirt 36, the outwardly facing surfaces 87, 90 of the magnets 52, 54, and the lower edge surfaces of the cylindrical walls 82, 84. It will be noted that the semi-cylindrical sheet engaging portions 130-134 of the gripping member 46 extend slightly outwardly above the plane formed by the skirt 72, magnets 52, 54 and cylindrical walls 82,84, so that the sheet engaging portion 132 of the sheet gripping member 46 is the primary contact point between the magnetic holder 10 and the sheet 12 to be gripped. This helps to ensure a secure grip on the sheet 12, because of the relatively high co-efficient of friction material, and the compressible nature of the material from which the gripping member 46 is made. Preferably, the gripping member is made from a rubber-like material.

The surface gripping member 48 is best shown in FIGS. 2, 4 and 6 as including a relatively larger diameter upper portion 138, a relatively larger diameter lower portion 140 having an end surface 141 and a relatively smaller portion 142 that is sized to be able to extend through an aperture 144 that extends through the body portion from the upper surface to the lower surface, adjacent to the first end 22 of the magnet holder 10.

The "plug-shaped" end of the surface gripping member 148 serves to hold it within the aperture 144. Ideally, the lower portion 140 is hemicylindrical or conical or mushroom-head shaped to facilitate its insertion through the aperture 144, to couple the surface gripping member 48 to the body portion 20.

The gripping member 48 is comprised of a material that may be similar or identical to the material from which the first, sheet-gripping member 46 is made. Even if made from a different material, the material chosen for the second gripping member 18 should have similar characteristics, and should be made from a compressible material whose surface has a higher co-efficient of friction than the plastic from which the body 20 is made. The gripping member 48 should be sized and sufficiently compressible so that the lower portion 140 can pass through the aperture 144.

The operation of the device will now be described with reference to FIGS. 7 and 8.

Figure 8:
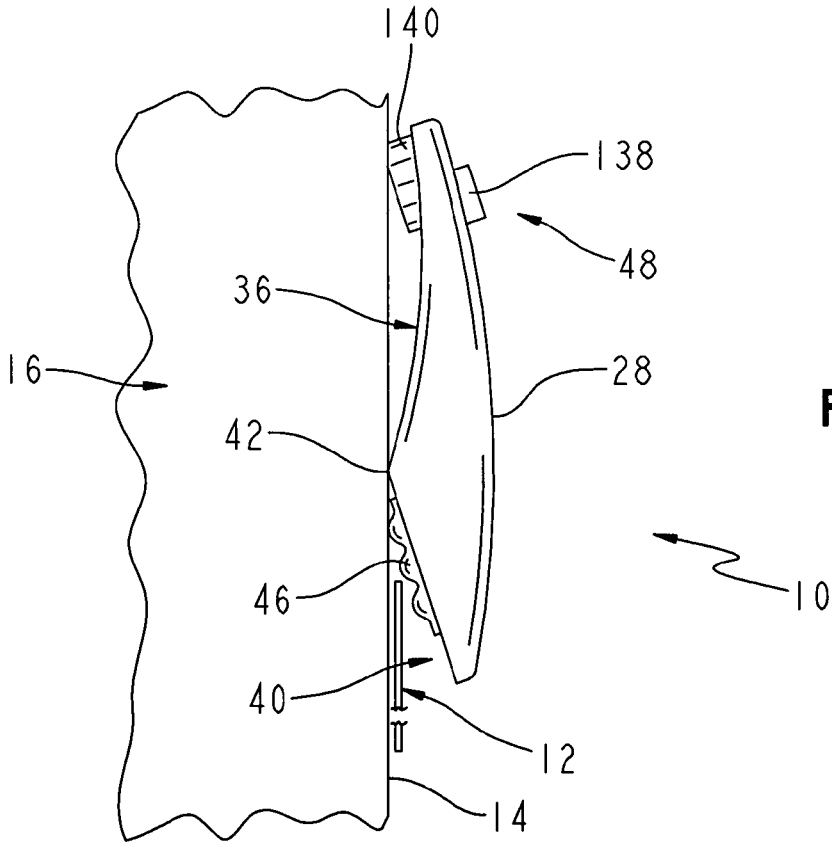
FIG. 8 is a side view of the present invention, similar to FIG. 7, showing the device in its release position.

The magnetic holder 10 of the present invention is movable between a grip position shown in FIG. 7, and a release position shown in FIG. 8. When in the grip position, (FIG. 7), the second portion 40 of the lower surface 30 extends in a plane generally parallel to both the sheet to-be-held 12 and the magnetically attractive surface 14. The lower surface 40 of the holder 10 engages the upper surface of the sheet 12.

The sheet 12 is sandwiched between the lower surface 40 and the magnetically attractive surface 14, that engages the underside surface of the sheet 12.

The magnets 52 employ magnetic attraction to hold the holder 10 tightly against the sheet 12 and hence the magnetically attractive surface 14 of the refrigerator door 16. As the gripping member 46 extends above the plane of the lower surface 40, the relatively higher co-efficient of friction gripping member 46, and in particular, its semi-cylindrical sheet-engaging portions 130, 132, 134 are pressed against the outwardly facing surface of the sheet 12 to prevent the sheet 12 from moving.

The sheet 12 is held by the first gripping member 46 not only through the frictional engagement of the gripping member 46, but also because of the magnetic attraction between magnets 52, 54 and magnetically attractive surface 14. Additionally, the friction engagement between the gripping member 46 and sheet 12 is enhanced because of the somewhat compressible nature of the gripping member 46.

As the first portion 36 is disposed at an obtuse angle to the second portion 40 of the lower surface 30 by fulcrum line 42, it will be noted that the first portion 36 is placed in a spaced relationship from the magnetically attractive surface 14, to create a gap therebetween. As discussed above, this gap should be great enough so that a standard-sized pencil or standard-sized stick pen type writing instrument P can be inserted in the gap, and be held in place in the gap by the force of gravity and frictional engagement.

When the device is moved into its release position, as shown in FIG. 8, the user exerts pressure against the upper portion 138 of the surface-gripping member 48, to pivot the holder 10 about the fulcrum line 42, to cause the lower surface 140 of the lower portion 140 of the surface gripping member 48 to frictionally engage the magnetically attractive surface 14. This frictional engagement helps to maintain the holder 10 in its position on the magnetically attractive surface 14, and prevents the holder 10 from sliding around on the surface 14. Simultaneously, the action of fulcrum line 42 causes the second portion 40 of the lower surface to be moved away from the magnetically attractive surface 14, to cause the second portion 40 to become disengaged from the sheet 12. In particular, the second portion 40 of the lower surface 30 should be moved far enough away from the sheet 12, to cause the gripping member 46 to become disengaged from the sheet 12. This disengagement permits the user to remove the non-magnetic sheet or picture 12 from its engagement with the holder 10, and, if so desired, to replace the picture 12 with another picture, grocery list, or similar sheet-like objects.

Having described the invention with reference to certain preferred embodiments, it will be appreciated by those skilled in the art that variations and modifications exist within the scope and spirit of the present invention, as defined by the following claims.

What is claimed is:

1. A magnetic holder for holding a non-magnetic sheet against a magnetically attractive surface comprising:

a body having a first end and a second end; an upper surface and a lower surface, the body being formed from a first material, the lower surface positioned for engaging the magnetically attractive surface, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed on the second portion for magnetically coupling the holder to the magnetically attractive surface, and a first gripping member comprised of a second material and coupled to the second portion of the lower surface for frictionally gripping the non-magnetic sheet.

2. The magnetic holder of claim 1 further comprising a non-magnetic sheet capable of being engaged by the magnetic holder and a magnetically attractive surface canable of being engaged by the magnetic holder, wherein the static co-efficient of friction between the second material and the non-magnetic sheet is greater than the static co-efficient of friction between the first material and the non-magnetic sheet.

3. A magnetic holder for holding a non-magnetic sheet against a magnetically attractive surface comprising:

a body having a first end and a second end; an upper surface and a lower surface, the body being formed from a first material, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed on the second portion for magnetically coupling the holder to the magnetically attractive surface, and a first gripping member comprised of a second material and coupled to the second portion of the lower surface for frictionally gripping the non-magnetic sheet, wherein the lower surface includes at least one well, and the first gripping member includes at least one leg received within the well for securing the first gripping member to the body.

4. The magnetic holder of claim 3 wherein the at least one well comprises at least three walls defining at least two wells, and the first gripping member includes at least two legs receivable in the at least two wells.

5. The magnetic holder of claim 4 wherein the lower surface includes at least one magnet receiving well for receiving the magnet member.

6. The magnetic holder of claim 5 wherein the magnet member includes first and second disk-shaped magnet members, and the at least one magnet receiving well includes a first magnet receiving well for receiving the first magnet member and a second magnet receiving well for receiving the second magnet member.

7. The magnetic holder of claim 6 wherein the first and second magnet receiving wells are spatially separated, and the at least three walls comprise at least three parallel walls extending between the first and second magnet receiving wells to define at least two wells disposed in parallel planes.

8. The magnetic holder of claim 7 further comprising a second gripping member disposed adjacent to the first end for frictionally gripping the magnetically attractive surface, the second gripping member comprised of a material.

9. The magnetic holder of claim 8 where the body includes a grip receiving aperture disposed adjacent to the first end for receiving the second gripping member, and the second gripping member includes an upper portion disposed above the upper surface, a lower portion disposed below the lower surface, and a middle portion extending through the grip receiving aperture.

10. The magnetic holder of claim 9 wherein the magnetic holder is movable between a gripping position wherein the second portion of the lower surface engages the magnetically attractive surface and the first end is spatially separated from the magnetically attractive surface; and a release position wherein the first portion of the lower surface engages the magnetically attractive surface, and the second end is spatially separated from the magnetically attractive surface wherein, when the holder is in the gripping position, the first end is spatially separated from the magnetic surface by a sufficient distance to permit a standard-sized pencil to be retained between the first end and the magnetically attractive surface.

11. The magnetic holder of claim 10 wherein the first portion of the lower surface is arcuate in cross section for retaining a writing instrument placed between the first portion and the magnetically attractive surface, when the holder is in the gripping position.

12. A magnetic holder for holding a non-magnetic sheet against a magnetically attractive surface comprising:

a body having a first end and a second end; an upper surface and a lower surface, the body being formed from a first material, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed adjacent to the portion for magnetically coupling the holder to the magnetically attractive surface, and a first gripping member coupled to the second portion of the lower surface for frictionally gripping the non-magnetic sheet, wherein at least one well is disposed adjacent to the second end, and the first gripping member includes at least one leg received within the well for securing the first gripping member to the body.

13. The magnetic holder of claim 1 wherein the body includes at least one magnet receiving well for receiving the magnet member.

14. A magnetic holder for holding a non-magnetic sheet against a magnetically attractive surface comprising:

a body having a first end and a second end; an upper surface and a lower surface, the body being formed from a first material, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed on the second portion for magnetically coupling the holder to the magnetically attractive surface, and a first gripping member comprised of a second material and coupled to the second portion of the lower surface for frictionally gripping the non-magnetic sheet, wherein the body includes at least one magnet receiving well for receiving the magnet member, and wherein the magnet member includes first and second disk-shaped magnet members and the at least one well includes a first magnet receiving well for receiving the first magnet member, and a second magnet receiving well for receiving the second magnet member, the first and second magnet receiving well being spatially separated, and wherein the body includes one well extending between the first and second magnet receiving wells, and the first gripping member includes at least one leg received within the well for securing the first gripping member to the body.

15. The magnetic holder of claim 1 wherein the second portion includes at least three walls defining at least two wells, and the first gripping member includes at least two legs receivable in the at least two wells for securing the first gripping member to the body.

16. The magnetic holder of claim 1 further comprising a non-magnetic sheet capable of being engaged by the magnetic holder and a magnetically attractive surface capable of being engaged by the magnetic holder, wherein the static co-efficient of friction between the second material and the non-magnetic sheet is greater than the static co-efficient of friction between the first material and the non-magnetic sheet, further comprising a second gripping member disposed adjacent to the first end for frictionally engaging the magnetically attractive surface, the second gripping member comprised of a third material having a static co-efficient of friction between the third material and the magnetically attractive surface that is greater than the static co-efficient of friction between the first material and the magnetically attractive surface.

17. The magnetic holder of claim 16 wherein the first and second gripping members are comprised of the same materials.

18. A magnetic holder for holding a non-magnetic sheet against a magnetically attractive surface comprising:

a body having a first end and a second end; an upper surface and a lower surface, the body being formed from a first material, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed on the second portion for magnetically coupling the holder to the magnetically attractive surface, and a first gripping member comprised of a second material and coupled to the second portion of the lower surface for frictionally gripping the non-magnetic sheet, a second gripping member disposed adjacent to the first end for frictionally engaging the magnetically attractive surface, the second gripping member comprised of a third material, wherein the body includes a grip receiving aperture disposed adjacent to the first end for receiving the second gripping member, and the second gripping member includes an upper portion disposed above the upper surface, a lower portion disposed below the lower surface, and a middle portion extending through the grip receiving aperture.

19. The magnetic holder of claim 1 wherein the magnetic holder is movable between a gripping position wherein the second portion of the lower surface engages the magnetically attractive surface and the first end is spatially separated from the magnetically attractive surface; and a release position wherein the first portion of the lower surface engages the magnetically attractive surface, and the second end is spatially separated from the magnetically attractive surface wherein, when the holder is in the gripping position, the first end is spatially separated from the magnetic surface by a sufficient distance to permit a standard-sized pencil to be retained between the first end and the magnetically attractive surface.

20. The magnetic holder of claim 19 wherein the first portion of the lower surface is arcuate in cross section for retaining a writing instrument placed between the first portion and the magnetically attractive surface, when the holder is in the gripping position.

21. A magnetic holder for holding a non-magnetic sheet against a magnetically attractive surface comprising a body having a first end and a second end; an upper surface and a lower surface, the body being formed from a first material, the lower surface being positioned to engage the magnetically attractive surface, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed on the second portion for magnetically coupling the holder to the magnetically attractive surface, and a surface gripping member disposed adjacent to the first end for frictionally engaging the magnetically attractive surface, the surface gripping member being comprised of a surface gripping material.

22. A magnetic holder for holding a non-magnetic sheet against a magnetically attractive surface comprising a body having a first end and a second end; an upper surface and a lower surface, the body being formed from a first material, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member disposed on the second portion for magnetically coupling the holder to the magnetically attractive surface, and a surface gripping member disposed adjacent to the first end for frictionally engaging the magnetically attractive surface, the surface gripping member being comprised of a surface gripping material wherein the body includes a grip receiving aperture disposed adjacent to the first end for receiving the surface gripping member, and the surface gripping member includes an upper portion disposed above the upper surface, and a lower portion disposed below the lower surface, and a middle portion extending through the grip receiving aperture.

23. The magnetic holder of claim 22 wherein the grip receiving aperture has a first diameter, the upper portion of the surface gripping member has a second diameter, and the lower portion of the surface gripping member has a third diameter, wherein the second and third diameters are greater than the first diameter.

24. The magnetic holder of claim 21, further comprising a sheet gripping member disposed on the second portion of the lower surface for frictionally gripping the non-magnetic sheet, the sheet gripping member being comprised of a sheet gripping material.

25. The magnetic holder of claim 21 wherein the magnetic holder is movable between a gripping position wherein the second portion of the lower surface engages the magnetically attractive surface and the first end is spatially separated from the magnetically attractive surface; and a release position wherein the first portion of the lower surface engages the magnetically attractive surface, and the second end is spatially separated from the magnetically attractive surface wherein, when the holder is in the gripping position, the first end is spatially separated from the magnetic surface by a sufficient distance to permit a standard-sized pencil to be retained between the first end and the magnetically attractive surface.

26. A magnetic holding system comprising a magnetic holder for holding a non-magnetic sheet against a magnetically attractive surface, a non-magnetic sheet capable of being engaged by the magnetic holder and a magneticallv attractive surface canable of being engaged by the magnetic holder, the magnetic holder comprising:

a body having a first end and a second end; an upper surface and a lower surface, the body being formed from a first material, the lower surface positioned for engaging the magnetically attractive surface, the lower surface having a first portion and a second portion, the first portion being joined to the second portion at a fulcrum line that defines an obtuse angle between the first portion and the second portion for preventing the first and second portions from engaging the magnetically attractive surface simultaneously, a magnet member coupled to the body adjacent to the second end for magnetically coupling the holder to the magnetically attractive surface, and a first gripping member comprised of a second material and coupled to the body adjacent to the second end for frictionally gripping the non-magnetic sheet, wherein a static co-efficient of friction is exhibited between the first material and the non-magnetic sheet that is less than a static co-efficient of friction exhibited between the second material and the non-magnetic sheet.

27. The magnetic holder of claim 26 further comprising a surface gripping member disposed adjacent to the first end for frictionally engaging the magnetically attractive surface, the surface gripping member being comprised of a surface gripping material, the surface gripping material and the magnetically attractive surface exhibiting a static co-efficient of friction greater than a static co-efficient of friction exhibited between the first material and the magnetically attractive surface.

* * * * *